US005618376A

United States Patent [19]

van der Storm

[11] Patent Number: 5,618,376

[45] Date of Patent: Apr. 8, 1997

[54] GIRDING DEVICE

[75] Inventor: Leonardus F. M. van der Storm, Zandvoort, Netherlands

[73] Assignee: Household Innovations International B.V., Netherlands

[21] Appl. No.: 403,705

[22] PCT Filed: Sep. 17, 1993

[86] PCT No.: PCT/NL93/00190

§ 371 Date: Mar. 17, 1995

§ 102(e) Date: Mar. 17, 1995

[87] PCT Pub. No.: WO94/06687

PCT Pub. Date: Mar. 31, 1994

[30] Foreign Application Priority Data

Sep. 18, 1992 [NL] Netherlands ..... 9201621

[51] Int. Cl.[6] ..... B65B 51/00

[52] U.S. Cl. ..... 156/468; 53/583; 156/475; 156/52; 156/579

[58] Field of Search ..... 156/468, 475, 156/476, 486, 492, 522, 579, 269; 53/583

[56] References Cited

U.S. PATENT DOCUMENTS

| | | | |
|---|---|---|---|
| 4,718,220 | 1/1988 | Van Rosendal et al. | 53/583 |
| 5,295,345 | 3/1994 | Ter Haar | 53/583 |

FOREIGN PATENT DOCUMENTS

| | | |
|---|---|---|
| 0188843 | 7/1986 | European Pat. Off. . |
| 7810993 | 5/1980 | Netherlands . |
| 91/02682 | 3/1991 | WIPO . |

*Primary Examiner*—George Yeung
*Attorney, Agent, or Firm*—Larson & Taylor

[57] ABSTRACT

A device for girding an article with a strip of adhesive tape whose ends adhere to one another where the device includes a housing with a cavity for accommodating a supply roll of adhesive tape, a star wheel rotatable with light friction having a number of spokes bounding identical, substantially radial recesses disposed at mutually equiangular distances, two mutually registered slits open on one side which are present in the front wall and the rear wall respective of the housing and which together bound a channel wherethrough an article for girding is moved from the open side. A movable positioning arm is arranged hingedly on a tilt piece which engages with its free end into a recess in the star wheel, whereby this star wheel is positioned such that another recess is situated in a channel and is ready to receive an article for girding. When the tilt piece is moved out of an inactive position into a cutting position, an arm is carried into a positioning position in a recess of the star wheel by a stop located on the tilt piece. A drawstring is connected on one side to the housing and on the other side to the positioning arm in a zone located on the side of the positioning arm remote from the free end.

11 Claims, 5 Drawing Sheets

GIRDING DEVICE

BACKGROUND AND SUMMARY

The invention relates to a device for girding an article with a strip of adhesive tape, whereof ends can adhere to one another, which device comprises:

a housing with a cavity for accommodating a supply roll of adhesive tape with:

means for guiding the tape;

means for carrying an article at least along and against the adhesive side of the first tape; and cutting means actuable by a through-fed article for severing the tape after the article has passed over the said means, a star wheel rotatable with light friction having a number of spokes bounding identical, substantially radial recesses disposed at mutually equal angular distances, two mutually registered slits open on one side which are present in the front wall and the rear wall respectively of the housing and which together bound a channel wherethrough an article for girding has to be moved from the open side, wherein the adhesive tape is guided over the top part of the star wheel with the sticking side facing outward, wherein the star wheel is formed and positioned relative to the slits such that an article for girding engages onto the star wheel in a recess thereof adheringly carrying with it the first tape, the opening of which recess is situated in the region of the slits, whereby the star wheel is set into rotation so that in the recess the article is girded with adhesive tape with the progressive rotation of the star wheel, and wherein the cutting means are placed downstream in relation to the star wheel and comprise a tilt piece with an actuating part movable pivotally about a pivot axis toward and away from the channel, which tilt piece is urged by spring means to a rest position wherein the cutting knife is located at a distance from the channel and the actuating part is located in the region of the channel for actuation of the tilt piece by an article carried through the channel while severing the tape with which an article is girded. Such a device is known for instance as sealer for bags with food products. The invention has for its object to provide a device, the operation of which is substantially independent of the dimensions of a through-fed article. A derived object of the invention in this respect is to provide a device which is for instance suitable for sealing plastic waste bags and binding bunches of flowers.

A problem with known devices of the said type is that the positioning of the star wheel can be greatly dependent on the thickness of a through-fed article. During girding of an article the star wheel has to be positioned such that a following article can be introduced into the channel without disturbance for girding by the device.

In order to ensure this positioning under all conditions, which is essential for good, disturbance-free operation of the device, the device according to the invention is characterized by a movable positioning arm, for instance arranged hingedly on the tilt piece which, in the position wherein the knife severs the tape, engages with its free end into a recess in the star wheel, whereby this star wheel is positioned such that another recess is situated in the region of the channel and is ready to receive an article for girding. This configuration has the additional advantage of requiring only very little space.

In preference the device has the feature that the free end of the positioning arm has a form adapted to the form of the recesses. This ensures a small contact pressure while retaining the desired disturbance-free operation.

A positive positioning is achieved with an embodiment which has the feature that when the tilt piece is moved out of the inactive position to the cutting position thereof the arm is carried to its positioning position in a recess of the star wheel by a stop present on the tilt piece.

In a preferred embodiment the device has the feature that the spring means comprise a draw spring connected on one side to the housing and on the other to the positioning arm in a zone located on the side of this positioning arm remote from the said free end. Two functions are here combined with one another, namely resetting of the tilt piece into its ready for operation position and the retraction of the positioning arm.

In order to press together as well as possible the adhering outer ends of the girding tape lying against each other the device can be characterized by a first resilient lip which presses in the region of the channel against the outer ends of the spokes of the star wheel. For this same purpose the device can be characterized by a deflection member which extends in the channel between the star wheel and the cutting means and which, during girding of an article, presses together with increased force the mutually facing adhering surfaces of the adhesive tape.

In order to make the longitudinal guiding of an article through the channel as good as possible, irrespective of its dimensions, the device can be characterized in a preferred embodiment by a strip extending in lengthwise direction of the channel with one side in that channel and resiliently loaded toward one of the longitudinal edges of the channel such that between the boundary of the channel and the said longitudinal edge a through-fed article is subjected to a pressing force on its zone girded by adhesive tape. The form of the active longitudinal edge of the strip is adapted to the form of the boundary of the channel located opposite. The strip forms with its longitudinal edge a slight impress in the handled article whereby a positive guiding is effected. Sideways sliding out of the article is hereby prevented. This sliding out in sideways direction is undesirable since the quality of the girding operation could thereby leave something to be desired.

This embodiment can have the particular feature that the strip is arranged hingedly on the input side of the channel.

The device can be embodied such that the strip is spring loaded by a second resilient lip.

This latter variant can have the characteristic that the first resilient lip and the second resilient lip are formed integrally. The said resilient lips can be of any suitable material, for instance spring steel.

In order to make the adhering action of the pressure-sensitive adhesive tape as strong as possible the device can display the feature that the tilt piece comprises a pushing part which is placed opposite the actuating part and which can exert a pushing force on the through-fed article during progressive tilting of the tilt piece.

As stated above, it is essential for good operation of the device that the star wheel can be positioned correctly by the positioning arm under all conditions, irrespective of the dimensions of a through-fed article. In this respect the invention preferably also has the feature that the ends of the spokes of the star wheel and the free end of the positioning arm are formed and co-act such that the said free end can enter a recess in any position of the star wheel while avoiding a dead point.

For manufacture of the device any suitable material can in principle be considered. It is recommended however to make use of a strong plastic which allows of processing by injection moulding. The device can have the particular feature that the device consists substantially of a strong plastic from the group to which ABS and polycarbonate belong.

The drawback to the said plastics is that they are relatively expensive, which could be a commercial obstacle in the case of simpler devices of the said type, for instance for consumer uses. It is therefore desirable to choose a material which is less expensive but which retains reasonable strength properties. In this respect the device can have the characteristic that the device consists substantially of polypropylene with a reinforcement of rockwool fibres. The combination of polypropylene with rockwool fibres has the great advantage of possessing substantially the same thermal properties as the above mentioned plastic ABS and of therefore allowing processing in the same injection moulds as ABS.

For the above stated applications such as sealing domestic refuse bags and binding of flowers it can be advantageous to provide the device with a hand-grip.

BRIEF DESCRIPTION OF THE DRAWING

The invention will now be elucidated with reference to the annexed drawing, wherein.

DESCRIPTION OF THE PREFERRED EMBODIMENTS

Figure 1:
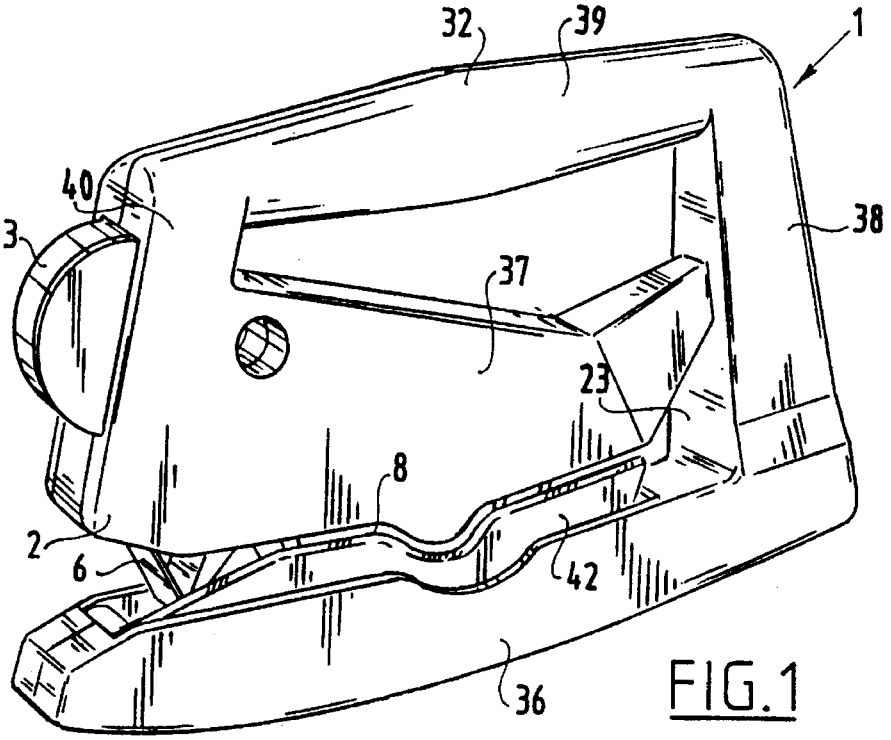
FIG. 1 shows a perspective view of an embodiment of the device according to the invention.
Figure 2:
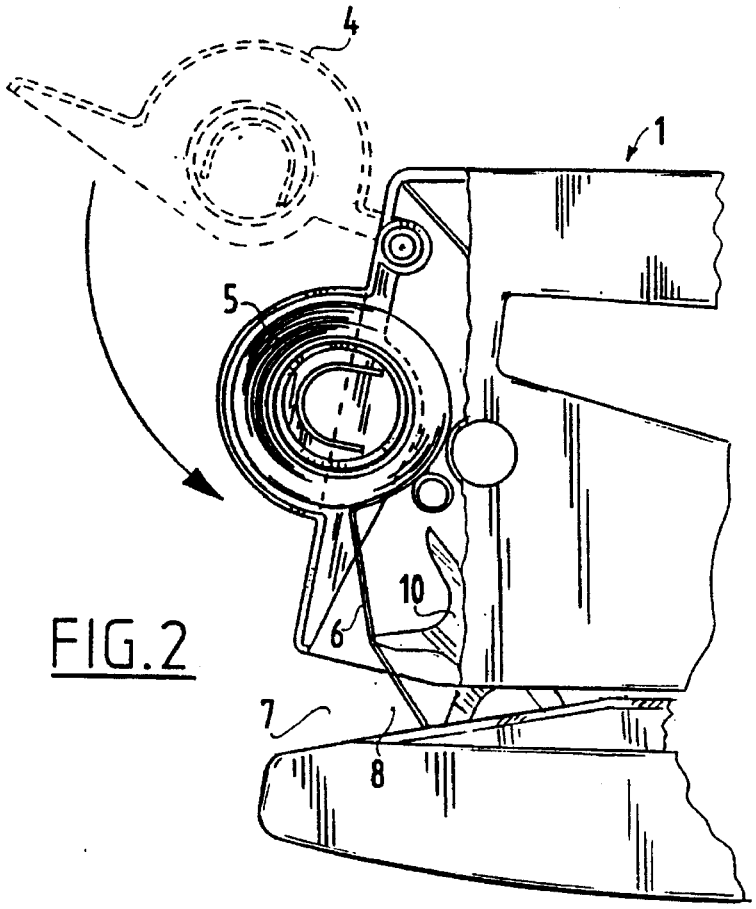
FIG. 2 is a partly broken away side view of the device according to FIG. 1.
Figure 6:
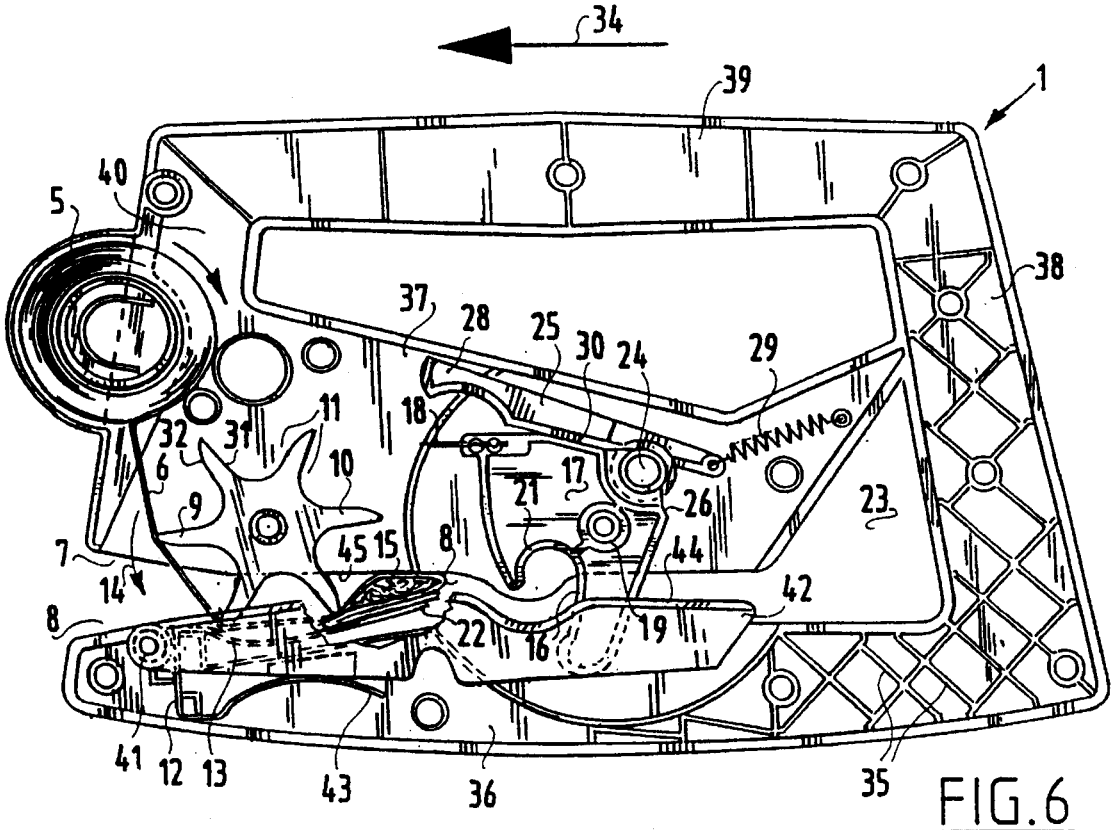

FIG. 1 shows a girding device 1 for girding an article, for instance a domestic refuse bag, with a strip of adhesive tape. The device comprises a housing 4 with a cavity 3 for accommodating a supply roll of adhesive tape which can be clearly seen in FIG. 2. In this embodiment the cavity forms part of an outwardly pivotable cover 4 whereby cavity 3 is accessible for insertion of a roll 5 of adhesive tape. Insertion takes place such that the sticking side of adhesive tape 6 faces outward and extends in the manner shown in FIG. 6 on the input side 7 of a channel 8 through which an article for girding has to be moved to be girded with adhesive tape by the device 1.

Figure 3:
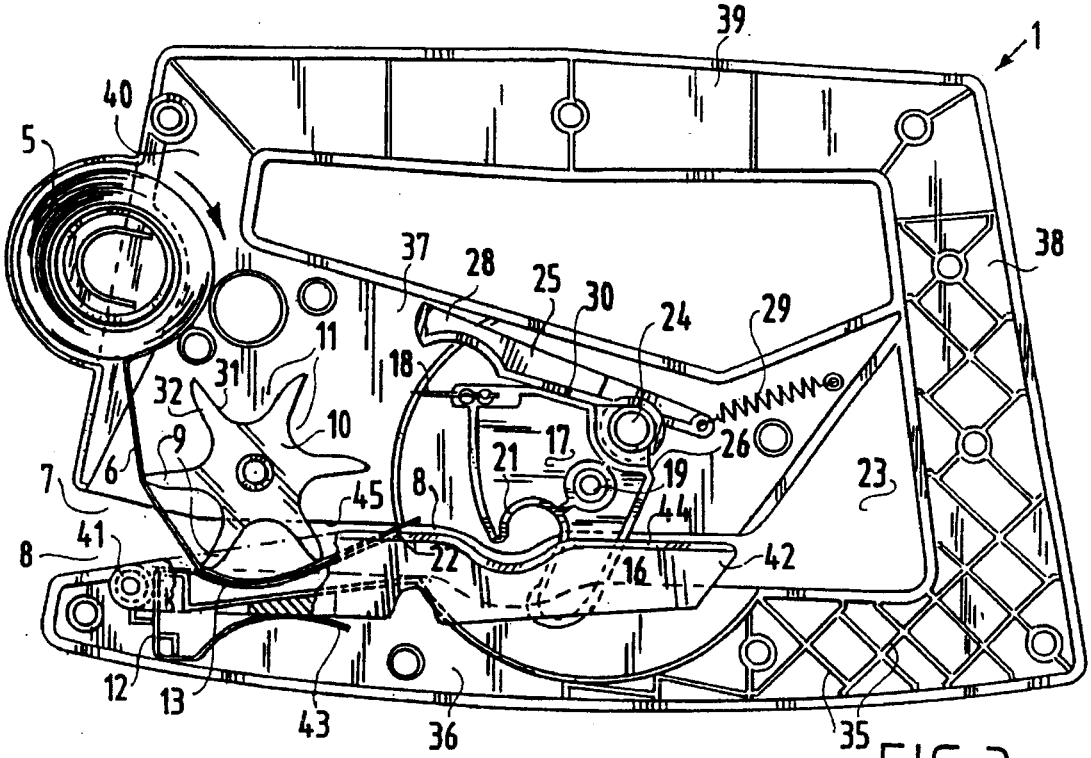
FIGS. 3, 4, 5, 6, 7, 8, 9 show longitudinal sections through the device of FIG. 1 in successive phases of the girding of an article.
Figure 4:
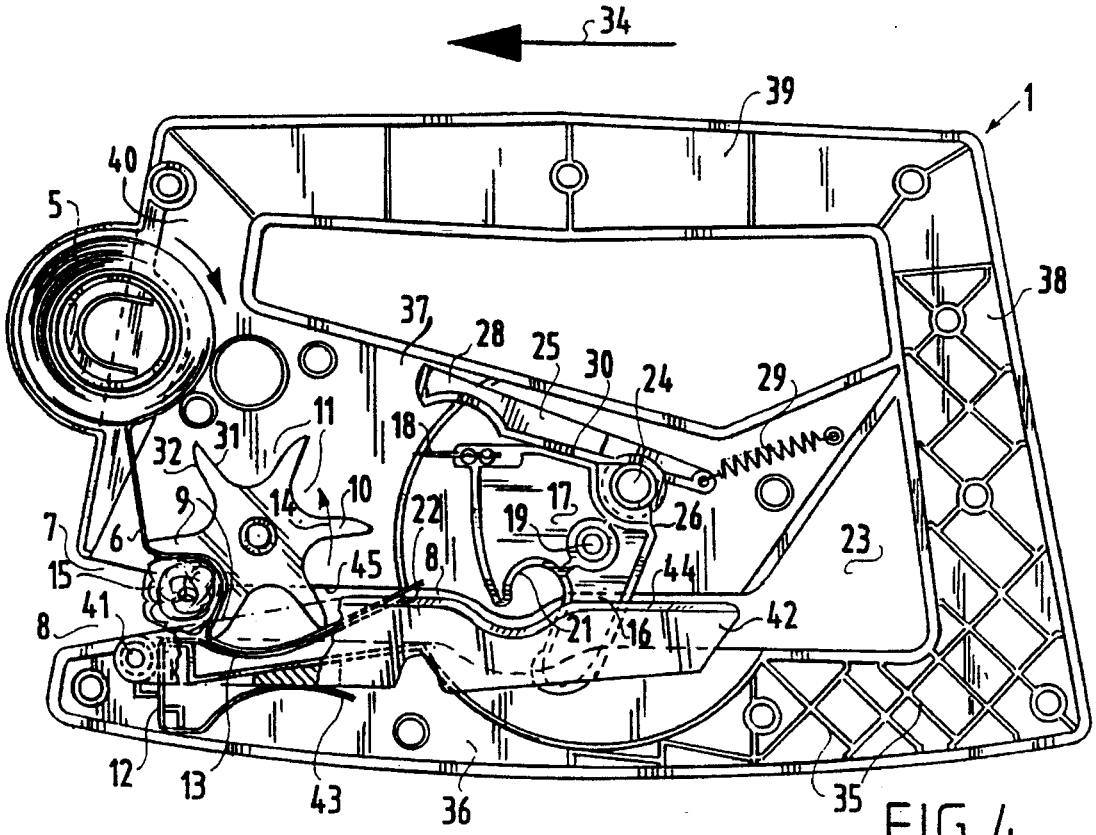
Figure 5:
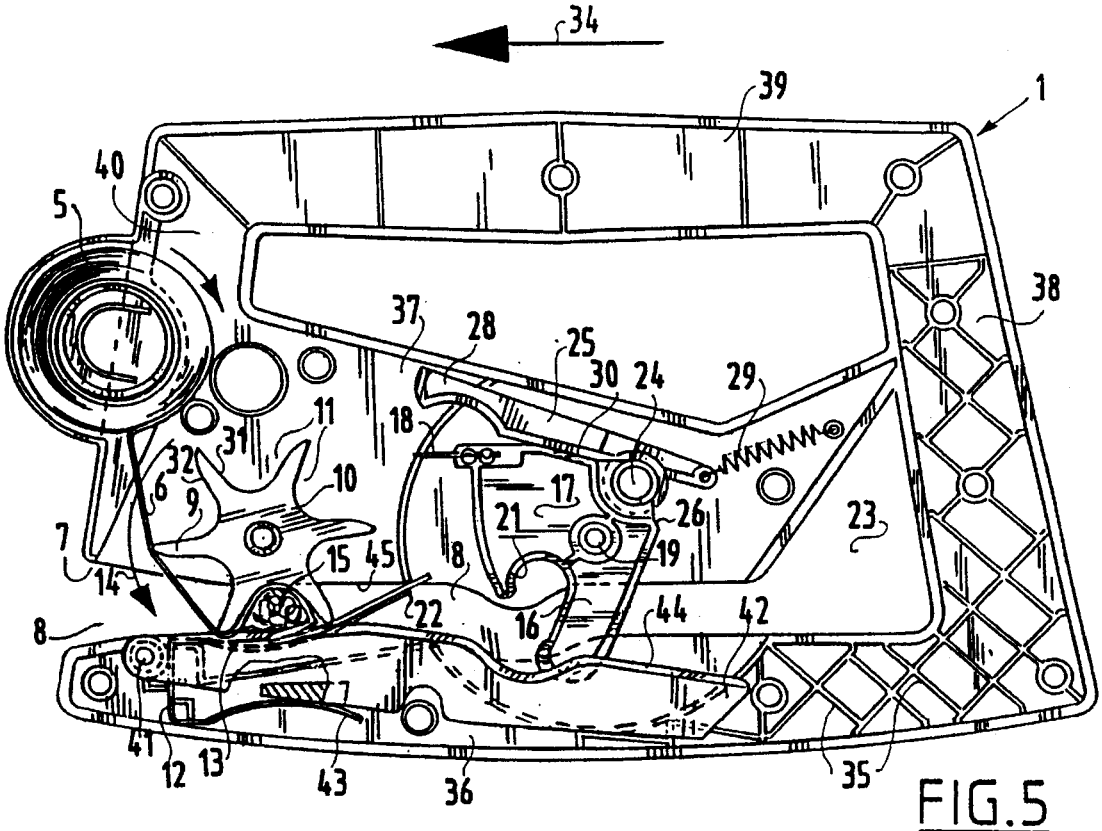

Reference is now made to FIGS. 3–9. FIG. 3 shows the device in its rest position. In this position the adhesive tape 6 is inserted such that it lies with its non-sticking side against the spokes 9 of a star wheel 10 mounted rotatably with slight friction in the housing 2. The spokes 9 bound recesses 11. A spring steel strip 12 has a portion 13 facing the star wheel 10 with a curved shape adapted thereto which corresponds with the dimensions and placing of the star wheel 10 such that the curved portion 13 exerts a pressing force in the direction of the ends of spokes 9. The adhesive tape 6 is hereby adhered to this curved portion 13.

The star wheel 10 is placed and dimensioned such that an article 15 introduced into the channel 8 (see FIG. 4) comes first into engagement with the tape 6 and then presses this tape against the bottom of a recess 11 of star wheel 10. A rotation of star wheel 10 hereby takes place as according to arrow 14 into the position shown in FIG. 5.

After continuing movement of the article 15 and after passing over the star wheel 10 the sticking ends of the adhesive tape protruding outside the article 15 are joined adheringly to each other. The article 15 is subsequently displaced further through the channel 8.

Figure 7:
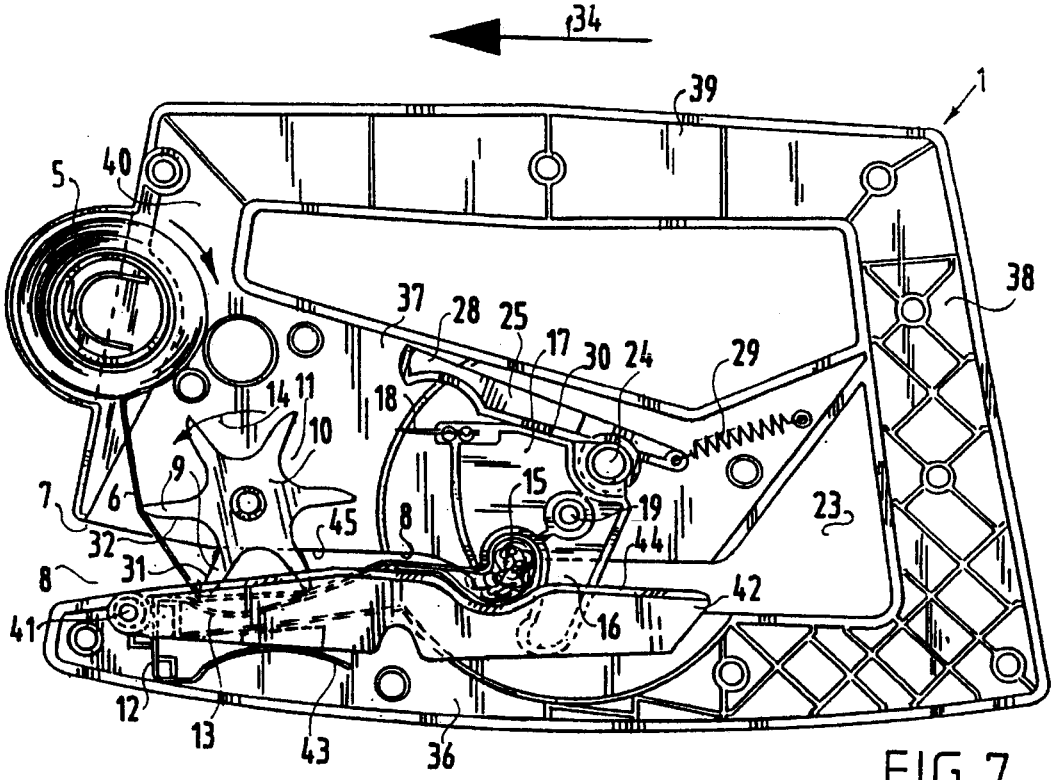

FIG. 7 shows that the article then comes into contact with the actuating part 16 of a tilt piece 17 which is hingedly mounted in housing 2 and which bears a knife 18. The hinge is designated with 19. The article 15 presses aside tilt piece 17 with its actuating part 16 in the direction of channel 8, whereby this tilt piece 17 undergoes tilting as according to arrow 20. During this displacement the article 15 meanwhile girded by adhesive tape 6 is pressed from the rear side by a press-on part 21. The pressure force between the sticking parts of tape 6 lying one on the other has meanwhile been increased in that the tape is forcibly deflected by a stiff deflection member 22 extending into channel 8.

Figure 8:
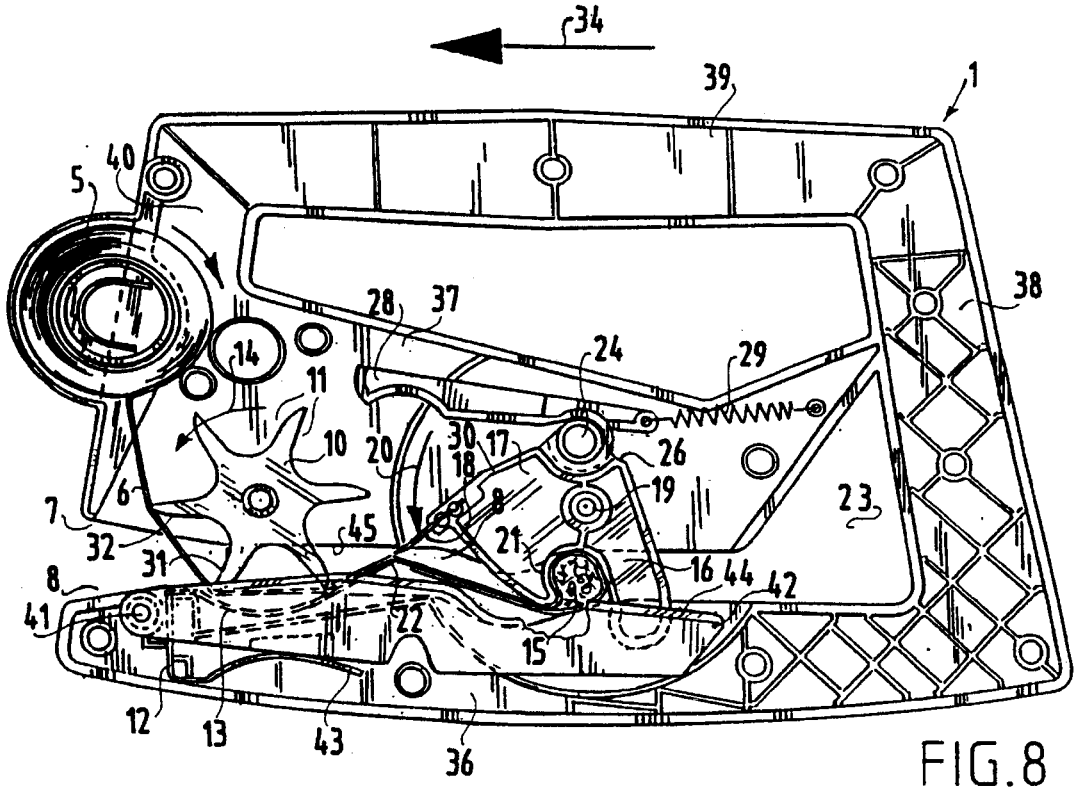

As a result of the tilting of tilt piece 17 shown in FIG. 8 the knife 18 is displaced such that it can cut through the tape 6, whereby the mutually adhering sticking ends are separated from the adhesive tape which is adhered to the strip 12 and is ready for girding a subsequent article.

Figure 9:
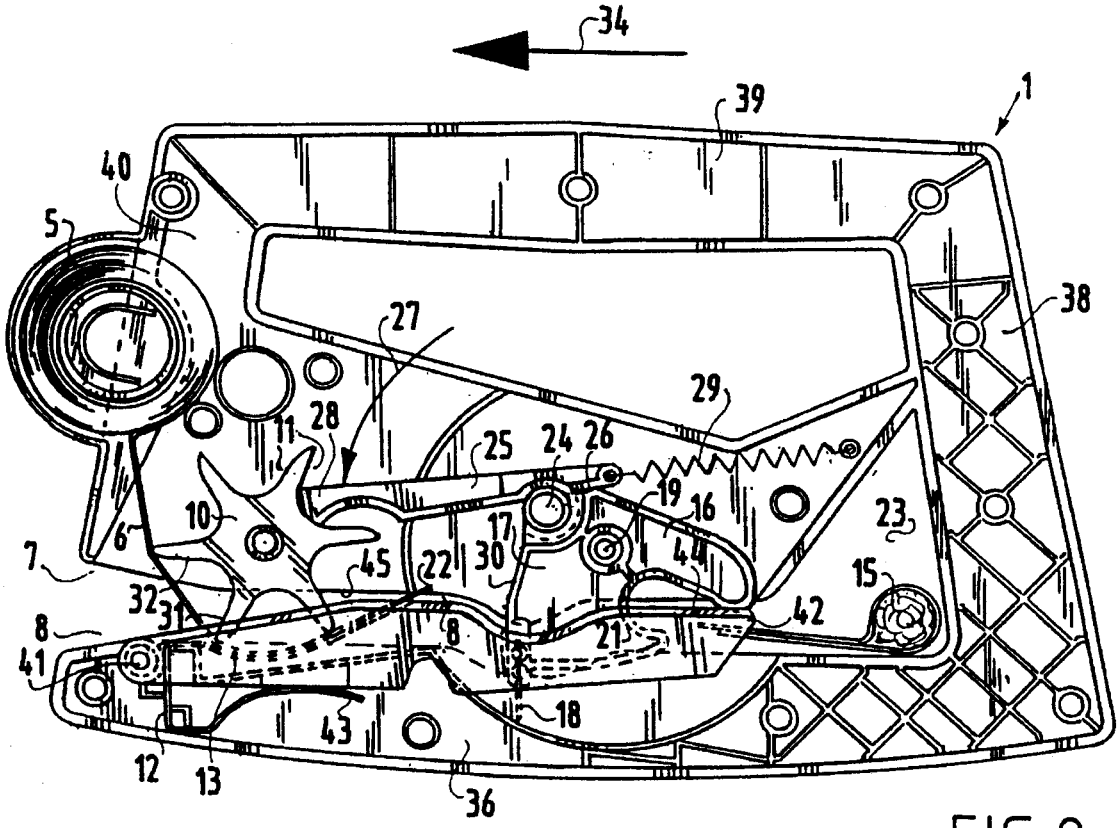

With further movement of the article 15 the tilt piece is carried into its position as shown in FIG. 9 in which the fully girded article 15 is situated in the end of the channel 8 and can be removed sideways out of the blind end zone 23 present there. In a manner to be described hereinbelow, a resetting of the tilt piece takes place after discontinuation of the tilting force thereon.

The tilt piece 17 bears via a hinge 24 a positioning arm 25 which serves to correctly position the star wheel 10. For this purpose tilt piece 17 has a stop 26 which ensures a positive carrying along of the positioning arm 25 according to arrow 27 during the transition between FIGS. 8 and 9. As shown in FIG. 9, engaging of the free end 28 of positioning arm 25 into the relevant recess 11 of star wheel 10 hereby takes place. This star wheel is hereby placed positively in the position shown in FIG. 3 in which a spoke 9 extends substantially in transverse direction relative to the channel 8 and is ready for processing a following article. The arm 25 is loaded on its end remote from the free end 28 by a draw spring 29 connected to housing 2. This draw spring 29 provides resetting of the tilt piece 17 and arm 25 into the rest position shown in FIG. 3. For this purpose the tilt piece also comprises a resetting stop surface 30 co-acting with arm 25.

Due to the freely pivotable attachment of positioning arm 25 to tilt piece 17, the free end 28 of the arm 25 can easily find the correct path to the bottom of the relevant recess 11. The form of the relevant end 28 is adapted to the form of the recesses 11 which all take an identical form and are grouped equidistantly. The form of the recesses 11 is asymmetrical. The press-on surface 31 of each recess, against which an introduced article presses, is substantially straight, while the opposite surface 32 has a form rounding to a tip. The shown and described configuration ensures a positive positioning of star wheel 10 by the free end 28 of arm 25 while avoiding the possibility of a dead zone existing between the two.

Housing 2 comprises a hand-grip 33 whereby the device is easily picked up with the hand in order to close for instance a domestic refuse bag with one continuous movement. The direction of displacement of device 1 for this purpose is designated with 34 in FIGS. 4–9.

With a view to the greatest possible strength the housing 2 is provided with an internal rib structure generally designated with 35. The housing consists of two halves which can be mutually joined in known manner, either by a snap connection or with adhesive, screws of any other suitable fastening.

The channel 8 is bounded by a first leg 36 and a second leg 37. Joining onto the first leg is a third leg 38, thereto a fourth leg 39 and thereto a fifth leg 40 which supports the second leg 37. The second leg 37 is joined to the third leg 38.

This more or less spiral-shaped structure combines simplicity of construction with the functional requirements, namely sufficient strength, the presence of a hand-grip and a channel.

Situated on the input side 7 of channel 8 is a hinge 41 which supports a guide strip 42. This latter is spring loaded by the bottom portion 43 of the spring steel strip 12 and is urged thereby in the direction of the star wheel 10 and tilt piece 17. The input side 7 of channel 8 is comparatively large for easy insertion of an article. An inserted article is guided during its displacement through channel 8 by the strip 14 pressing resiliently thereagainst. The latter is provided for this purpose with a more or less sharply tapering active edge 44. The shape of this edge 44 is adapted to the oppositely located bounding edge 45 of channel 8.

What is claimed is:

1. Device for girding an article with a strip of adhesive tape, whereof ends can adhere to one another, said device comprising:

a housing with a cavity for accommodating a supply roll of adhesive tape, said housing including means for guiding the tape, means for carrying an article at least along and against the adhesive side of the adhesive tape, and cutting means actuable by a through-fed article for severing the tape after the article has passed over said cutting means;

a star wheel rotatable with light friction having a number of spokes bounding identical, substantially radial recesses, disposed at mutually equal angular distances;

two mutually registered slits having an open side, said slits being present in a front wall and a rear wall respectively of the housing and which said walls together bound a channel wherethrough an article for girding is moved from the open side, wherein the adhesive tape is guided over the top part of the star wheel with the adhesive side facing outward;

wherein the star wheel is formed and positioned relative to the slits such that an article for girding engages onto the star wheel in a recess thereof adheringly carrying with the article the adhesive tape, the opening of which recess is situated in the region of the slits, whereby the star wheel is set into rotation so that in the recess the article is girded with the adhesive tape with the progressive rotation of the star wheel; and wherein the cutting means are placed downstream in relation to the star wheel and comprise a tilt piece with an actuating part movable pivotally about a pivot axis toward and away from the channel, which said tilt piece is urged by a spring means to a peak position wherein the cutting means is located at a distance from the channel and the actuating part is located in a region of the channel for actuating of the tilt piece by an article carried through the channel to a cutting position for severing the tape wherewith the article is girded;

said device further comprising a movable positioning arm arranged hingedly on the tilt piece which, in the position wherein the cutting means severs the tape, engages with a free end thereof and into a recess in the star wheel, whereby this star wheel is positioned such that another recess is situated in the region of the channel and is ready to receive an article for girding;

wherein, when the tilt piece is moved out of the peak position to the cutting position thereof, the arm is carried to a positioning position in a recess of the star wheel by a stop present on the tilt piece; and wherein the spring means comprises a draw spring connected at one side to the housing and on the other side to the positioning arm in a zone located on a side of the positioning arm remote from the free end.

2. Device as claimed in claim 1, wherein said spokes have outer ends and said device further comprises a first resilient lip which presses against the outer ends of the spokes of the star wheel.

3. Device as claimed in claim 1, further comprising a deflection member which extends in the channel between the star wheel and the cutting means and which, during girding of an article, presses together with increased force the facing adhering side of the adhesive tape.

4. Device as claimed in claim 2, wherein said channel has longitudinal edges and a boundary and said device further comprises a strip extending in a lengthwise direction of the channel with one side in that channel and resiliently loaded toward one of the longitudinal edges of the channel such that a through-fed article having a girding zone is subjected to a press-on force on said girding zone by the adhesive tape located between the boundary of the channel and the longitudinally edge.

5. Device as claimed in claim 4, wherein the strip is arranged hindedly on the open side of the channel.

6. Device as claimed in claim 5, wherein the strip is spring loaded by a second resilient lip.

7. Device as claimed in claim 6, wherein the first resilient lip and the second resilient lip are formed integrally.

8. Device as claimed in claim 1, wherein the tilt piece comprises a pushing part which is placed opposite the actuating part and which exerts a pushing force on the through-fed article during progressive tilting of the tilt piece.

9. Device as claimed in claim 1, wherein the housing and wheel are made substantially from a strong plastic from the group to which ABS and polycarbonate belong.

10. Device as claimed in claim 1, wherein the housing and wheel are made substantially from polypropylene with a reinforcement of rockwool fibres.

11. Device as claimed in claim 1, wherein the device is provided with a hand-grip.

* * * * *